US009283755B2

(12) United States Patent
Muraoka et al.

(10) Patent No.: US 9,283,755 B2
(45) Date of Patent: Mar. 15, 2016

(54) LIQUID EJECTION HEAD

(71) Applicant: CANON KABUSHIKI KAISHA, Tokyo (JP)

(72) Inventors: Chiaki Muraoka, Kawaguchi (JP); Yukuo Yamaguchi, Tokyo (JP); Takuya Iwano, Inagi (JP); Keiji Tomizawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/439,376

(22) PCT Filed: Oct. 10, 2013

(86) PCT No.: PCT/JP2013/006054
§ 371 (c)(1),
(2) Date: Apr. 29, 2015

(87) PCT Pub. No.: WO2014/068861
PCT Pub. Date: May 8, 2014

(65) Prior Publication Data

US 2015/0290934 A1 Oct. 15, 2015

(30) Foreign Application Priority Data

Oct. 30, 2012 (JP) ..... 2012-238944

(51) Int. Cl.
*B41J 2/05* (2006.01)
*B41J 2/14* (2006.01)

(52) U.S. Cl.
CPC ..... *B41J 2/14016* (2013.01); *B41J 2/1404* (2013.01); *B41J 2/1433* (2013.01); *B41J 2002/14185* (2013.01); *B41J 2002/14475* (2013.01)

(58) Field of Classification Search
CPC ..... B41J 2/135; B41J 2/14; B41J 2/1404; B41J 2/1412; B41J 2002/14475
See application file for complete search history.

(56) References Cited

U.S. PATENT DOCUMENTS 7,887,159 B2 * 2/2011 Takei et al. ..... 347/47
2007/0081034 A1 4/2007 Worsman et al.

(Continued)

FOREIGN PATENT DOCUMENTS

CN 101316712 A 12/2008
DE EP 0 770 487 A1 * 5/1997 ..... B41J 2/16
EP 0770487 A1 5/1997

(Continued)

*Primary Examiner* — Geoffrey Mruk
(74) *Attorney, Agent, or Firm* — Canon USA, Inc. IP Division

(57) ABSTRACT

A liquid ejection head includes a discharge orifice configured to eject liquid; a device configured to generate energy for use in ejecting liquid; a pressure chamber partitioned by a wall, the pressure chamber accommodating the device and communicating with the discharge orifice; and a channel configured to supply liquid to the pressure chamber, wherein the discharge orifice has first and second protrusions protruding from the edge of the discharge orifice toward the central portion in an extending direction of the channel along the center line of the channel, and the interval between the base of the first protrusion and the base of the second protrusion in the extending direction of the channel is larger than the maximum interval between the edges of the discharge orifice in a direction perpendicular to the extending direction.

7 Claims, 17 Drawing Sheets

(56) References Cited

U.S. PATENT DOCUMENTS

| | | | |
|---|---|---|---|
| 2007/0146437 | A1 | 6/2007 | Murakami et al. |
| 2008/0291244 | A1 | 11/2008 | Koizumi et al. |

FOREIGN PATENT DOCUMENTS

| | | | |
|---|---|---|---|
| EP | 1995069 | A1 | 11/2008 |
| JP | 2007/064021 | A | 3/2007 |

* cited by examiner

LIQUID EJECTION HEAD

TECHNICAL FIELD

The present invention relates to a liquid ejection head that ejects liquid.

BACKGROUND ART

In an image forming apparatus that forms an image on a recording medium, a liquid ejection head includes a plurality of discharge orifices that eject liquid, such as ink, as droplets. The droplets ejected from the discharge orifices of the liquid ejection head are each formed of a main drop portion formed in a spherical shape at the distal end of the droplet and a liquid column (tail) following the main drop portion. The liquid column is separated from the main drop portion, and the liquid column itself is divided to form a subdrop portion (satellites). To form an image on a recording medium, it is preferable that the number of satellites be small because the satellites cause displacement of landing positions. PTL 1 discloses a liquid ejection head having a structure in which protrusions are provided at the edge of a discharge orifice to reduce the number of satellites of the droplets.

The protrusions at the discharge orifice of the liquid ejection head protrude toward the center of the interior of the discharge orifice in a direction parallel to the scanning direction of the liquid ejection head. Providing the pair of protrusions at the discharge orifice so as to protrude toward the center of the interior of the discharge orifice makes it easy to separate ejected ink droplets and remaining ink from each other. Furthermore, a resistance difference caused in the discharge orifice by the pair of protrusions can shorten the tail, thereby reducing the number of satellites.

The liquid ejection head adopts a thermal system that heats ink and ejects it as droplets. The liquid ejection head includes heaters for heating ink and pressure chambers accommodating the heaters and has discharge orifices on the heaters in such a manner that the centers coincide with the centers of the individual heaters. To form the discharge orifices, the pressure chambers, and so on of the liquid ejection head, photolithography for obtaining a desired shape by exposure and development is used.

However, according to the invention disclosed in PTL 1, the correlation between the discharge orifices and the exposure positions of the pressure chambers can be deviated during manufacture by photolithography due to variations in processing accuracy in the manufacturing process. If the discharge orifice is formed in a offset position in a direction perpendicular to the protruding direction of the protrusions of the discharge orifice due to the deviation, the interval between the edge of the discharge orifice and the wall of the pressure chamber becomes extremely small because the pressure chamber is smaller than the discharge orifice in plan view. When ink is ejected through the thus-configured discharge orifice, the tails of ink droplets during ejection bend from the center of the discharge orifice in a direction in which the edge of the discharge orifice and the wall of the pressure chamber are in close contact since the center of the discharge orifice and the center of the pressure chamber differ in plan view. The bending of the tails causes the main drops and the satellites to land at positions out of target landing positions on the recording medium, thus posing the problem of degrading the image quality of the recording medium.

CITATION LIST

Patent Literature

PTL 1: International Publication No. 2007/064021

SUMMARY OF INVENTION

The present invention provides a liquid ejection head including a discharge orifice configured to eject liquid; a device configured to generate energy for use in ejecting liquid; a pressure chamber partitioned by a wall, the pressure chamber accommodating the device and communicating with the discharge orifice; and a channel configured to supply liquid to the pressure chamber, wherein the discharge orifice has first and second protrusions protruding from the edge of the discharge orifice toward the central portion in an extending direction of the channel along the center line of the channel, and the interval between the base of the first protrusion and the base of the second protrusion in the extending direction of the channel is larger than the maximum interval between the edges of the discharge orifice in a direction perpendicular to the extending direction.

Further features of the present invention will become apparent from the following description of exemplary embodiments with reference to the attached drawings.

DESCRIPTION OF EMBODIMENTS

Embodiments of the present invention will be described hereinbelow with reference to the drawings.

First Embodiment

Figure 1:
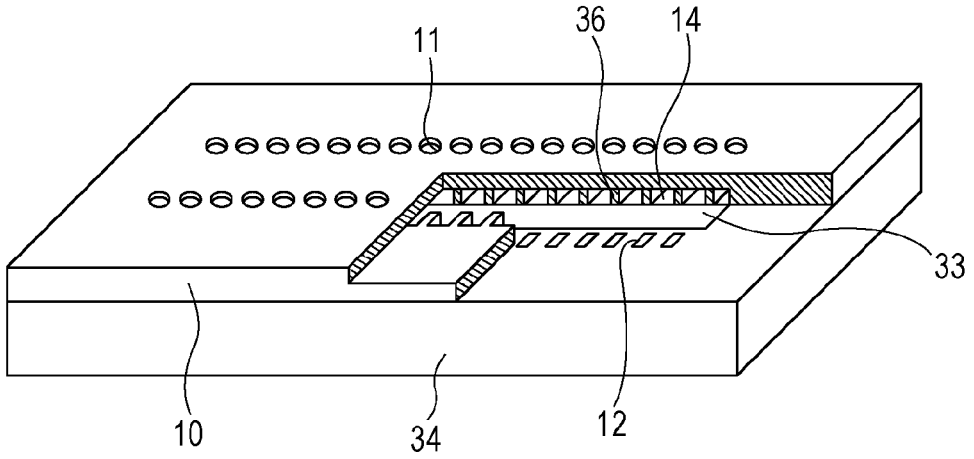
FIG. 1 is a perspective view illustrating the configuration of part of a liquid ejection head according to an embodiment of the present invention.

FIG. 1 is a perspective view illustrating the configuration of part of a liquid ejection head mounted on an image forming apparatus, according to an embodiment of the present invention.

The liquid ejection head includes a substrate 34, a supply port 33 provided in the substrate 34, a plurality of heaters (energy generation devices) 12 arrayed in one direction on both sides of the supply port 33, channels 14 communicating with the supply port 33, and a plurality of discharge orifices 11 provided in correspondence with the heaters 12.

Wires (not shown) connected to the heaters 12 are formed on the surface of the substrate 34. An orifice plate 10 having the plurality of discharge orifices 11 and so on is connected to the substrate 34. The supply port 33 is a long-groove-like through-hole for supplying liquid to the channels 14. The heaters 12 are devices for converting electrical energy to thermal energy for use in ejecting ink and are formed on the surface of the substrate 34 in a pair of trains so as to have the supply port 33 therebetween. The pair of trains of heaters 12 are each disposed at an interval of 600 dpi in a staggered arrangement, so that the two trains of heaters 12 are arranged at an interval of 1200 dpi in the longitudinal direction.

Figure 2A:
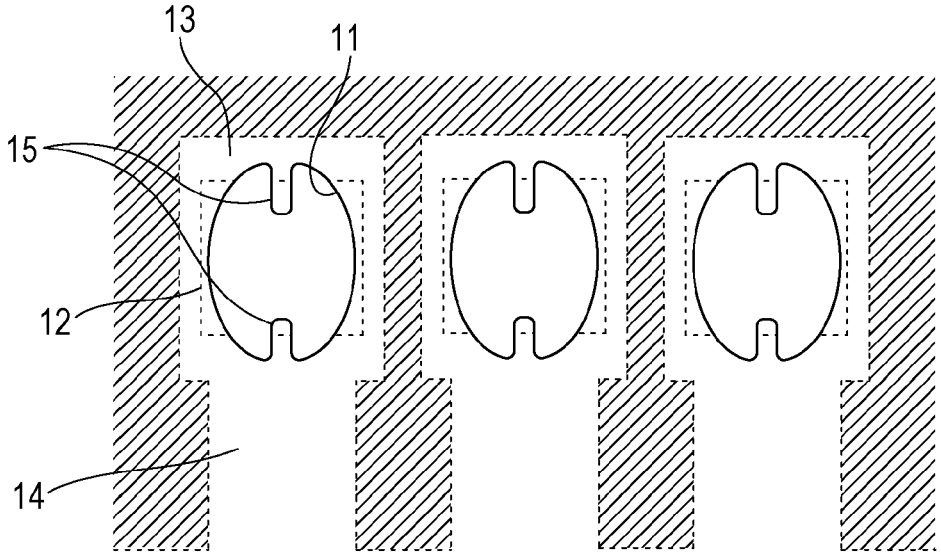
FIG. 2A is a plan view illustrating the positional relationship among discharge orifices, heaters, pressure chambers, and channels according to a first embodiment of the present invention.

The pressure chambers 13 (see FIG. 2A) are formed so as to accommodate the individual heaters 12. The pressure chambers 13 are partitioned by walls 36. The discharge orifices 11 and the pressure chambers 13 communicate with each other. The heaters 12 are disposed directly under the discharge orifices 11. The channels 14 are passages that connect the supply port 33 with the pressure chambers 13 to supply ink (liquid) to the pressure chambers 13 through the supply port 33. The channels 14 each pass through at least one of the walls 36 of the pressure chamber 13, which are perpendicular to a flat surface (formed surface) in which the discharge orifices 11 are formed, to communicate with the pressure chamber 13.

Figure 2B:
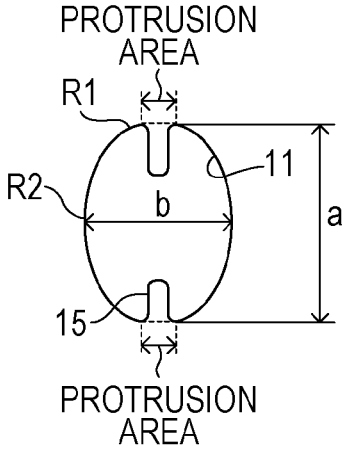
FIG. 2B is an enlarged view illustrating the shape of the discharge orifice.

As shown in FIG. 2B, the discharge orifices 11 are each defined by an edge having curvatures and has a long and thin shape in which a length a in a direction in which ink flows from the channel 14 to the pressure chamber 13 is larger than a width b perpendicular to the ink flowing direction. In addition, the discharge orifice 11 has at least one (two, in the first embodiment) protrusion 15 (first and second protrusions) at the edge. The protrusions 15 protrude from the edge of the discharge orifice 11 toward the central portion, or the center of the interior, of the discharge orifice 11 and are opposed to each other along the extending direction of the channel 14. Thus, the interval a between the base of the first protrusion and the base of the second protrusion is larger than the maximum interval b between the edges of the discharge orifice 11 in the direction perpendicular to the extending direction of the channel 14.

The protrusions 15 and the edge of the discharge orifice 11 are connected in a curved shape. The curvature of portions R2 at which the direction in which ink flows from the channel 14 to the pressure chamber 13 and a tangent to the edge are parallel to each other is smaller than the curvature of portions R1 next to the protrusions 15. The portion R1 next to the protrusion 15 does not include the protrusion 15 itself and the curve between the protrusion 15 and the edge of the discharge orifice 11. The curvature of the portion R1 next to the protrusion 15 can be regarded as the curvature of a portion of a virtual edge, which is substantially perpendicular to the flowing direction of ink, on the assumption that there is no protrusion 15.

Figure 3A:
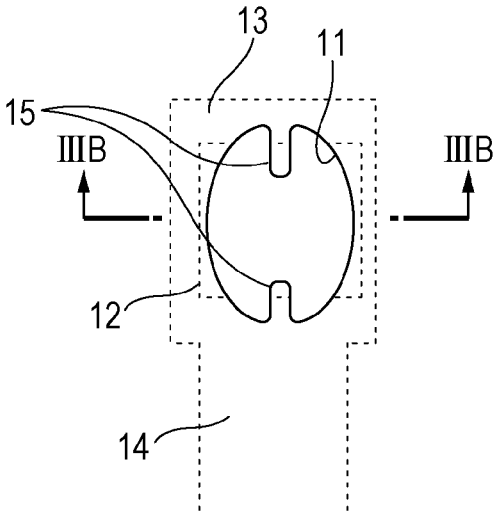
FIG. 3A is a plan view of the discharge orifice of the first embodiment in a displaced position due to variations in manufacturing process.
Figure 3B:
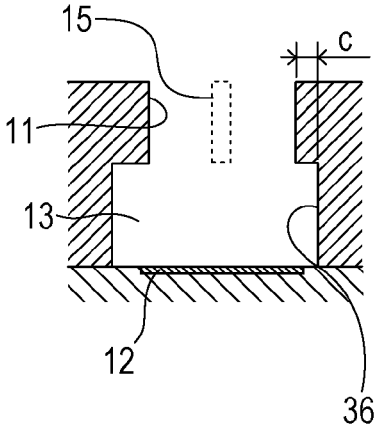
FIG. 3B is a cross-sectional view taken along line IIIB-111B in FIG. 3A.

The orifice plate 10 is formed of a photosensitive plastic material. The channels 14, the pressure chambers 13, and the discharge orifices 11 are formed by performing exposure to light and development on the orifice plate 10 by using photolithography. The use of the photolithography may change the positional relationship between the pressure chambers 13 and the discharge orifices 11 due to variations in processing accuracy, such as a position irradiated with light and a light refracting direction. FIGS. 3A and 3B illustrate a configuration in which the discharge orifice 11 is offset to the right with respect to the center of the pressure chamber 13 because processing variations have occurred when the channels 14, the pressure chambers 13, and the discharge orifices 11 are formed using photolithography. Specifically, the discharge orifice 11 is offset with respect to the pressure chamber 13 in the direction perpendicular to the direction in which ink flows from the channel 14 to the pressure chamber 13. At that time, the interval c between the edge of the discharge orifice 11 and the wall 36 of the pressure chamber 13 is smaller than the interval when the discharge orifice 11 is formed without variations.

A method for ejecting ink with the thus-configured liquid ejection head will be described.

Figure 4:
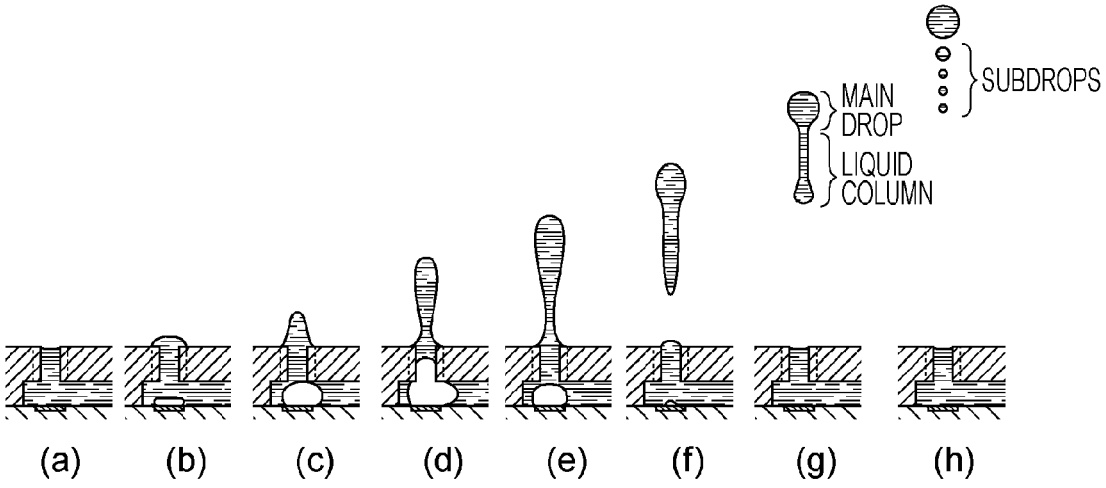
FIG. 4, (a) to (h), is a diagram illustrating the process of ejecting liquid with the liquid ejection head of the first embodiment.

When the image forming apparatus has received image data, the scanning path of the liquid ejection head, the kind of ink to be ejected, the timing thereof, and so on are set. Ink is conveyed from an ink tank (not shown) to the supply port 33 and is then supplied to the pressure chambers 13 through the channels 14. The heaters 12 generate thermal energy in synchronization with the timing at which the liquid ejection head scans directly on the recording surface of the recording medium to bring the ink to film boiling, thereby forming bubbles, and the ink is pushed by the bubbles and is ejected from the discharge orifices 11, as shown in FIG. 4, (a) to (h).

The average amount of ink ejected from each of the discharge orifices 11 per ejection is about 12 pl.

The ink is ejected as droplets. The droplets are each formed of a main drop formed in a spherical shape at the distal end of the droplet and a liquid column (tail) following the main drop portion. The liquid column itself is divided to form a subdrop portion (satellites). The main drop is repeatedly landed on a plurality of desired positions on the recording surface of the recording medium to form an image. However, not only the main drops for forming an image but also the satellites land on the recording surface of the recording medium, and if the number of satellites is large, the quality of the image formed on the recording medium is degraded, and thus, the number of satellites needs to be decreased. In this embodiment, two protrusions are provided at each of the discharge orifices 11 to intentionally generate a flow resistance difference in the discharge orifice 11, thereby obtaining the effect of shortening the tail. Since the shortening of the tails of the droplets decreases the number of satellites, degradation of the quality of the image formed on the recording medium is prevented.

The bubbles generated by each heater 12 when ink is ejected push the ink from the pressure chamber 13 not only toward the discharge orifice 11 but also toward the channel 14. The flow of the ink from the pressure chamber 13 toward the channel 14 forces the endmost portion of the tail of the droplet during ejection of the ink to bend toward the channel 14. The bending of the tails due to the force causes the satellites to be ejected in directions different from the discharge direction of the main drops to cause landing failures, or the increased number of satellites degrades the quality of the image. Therefore, this embodiment is configured such that the protrusions provided at the edge of each discharge orifice 11 protrude in a direction parallel to the channels 14 to prevent the tails from bending toward the channels 14. Preventing the tails from bending during ejection of ink allows the main drops and the satellites to be ejected in the same direction, and a decrease in the number of satellites prevents degradation of image quality.

Figure 5:
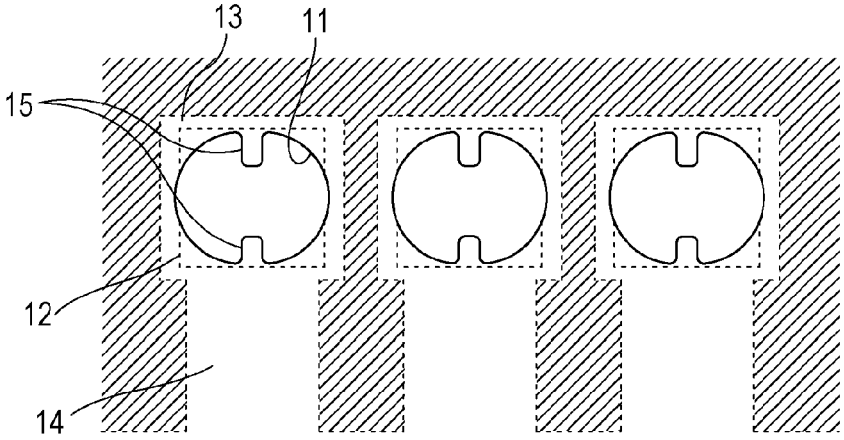
FIG. 5 is a plan view illustrating the positional relationship among discharge orifices, heaters, pressure chambers, and channels as a comparative example.
Figure 6A:
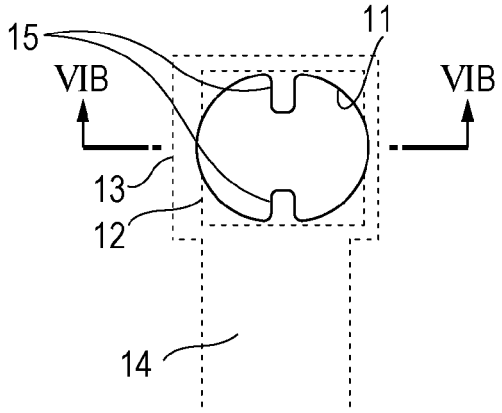
FIG. 6A is a plan view of the discharge orifice of the comparative example in a displaced position due to variations in manufacturing process.
Figure 6B:
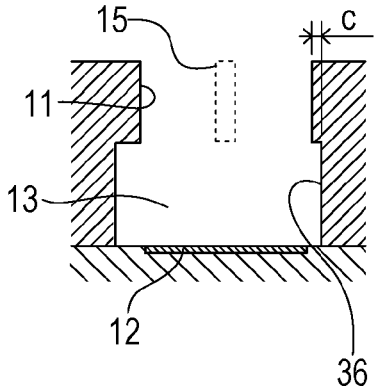
FIG. 6B is a cross-sectional view taken along line VIB-VIB in FIG. 6A.
Figure 11A:
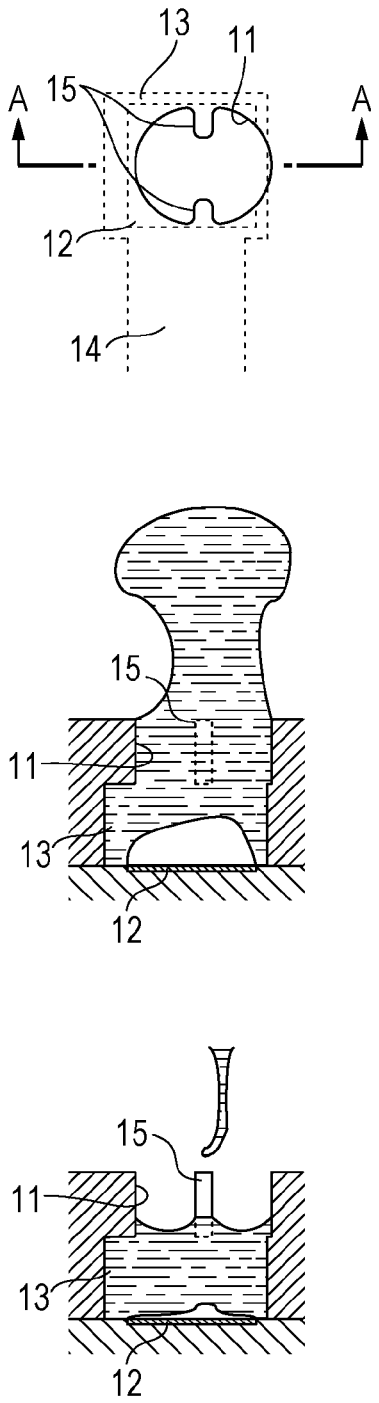
FIG. 11A is a diagram illustrating the liquid ejection head of the comparative example.
Figure 11B:
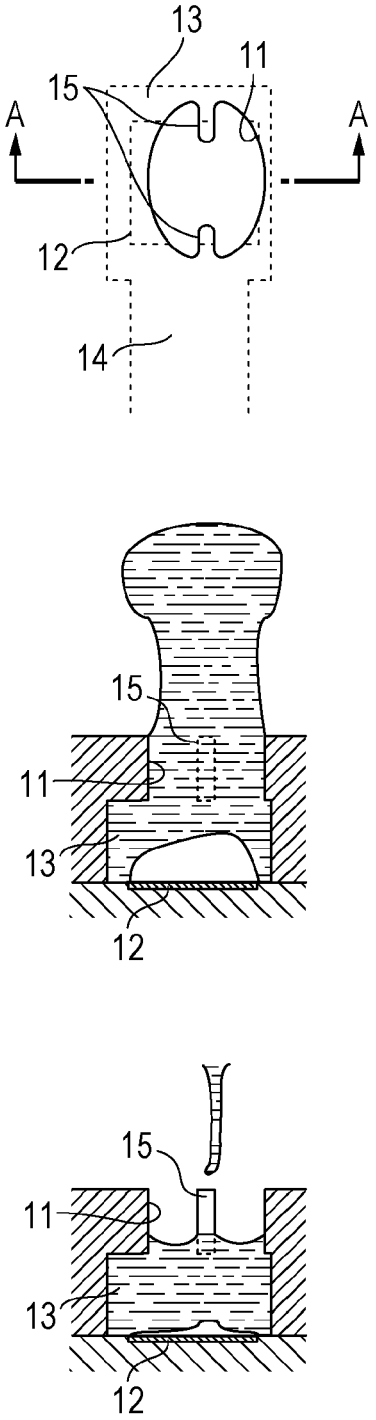
FIG. 11B is a diagram of the liquid ejection head according to the first embodiment.
Figure 11C:
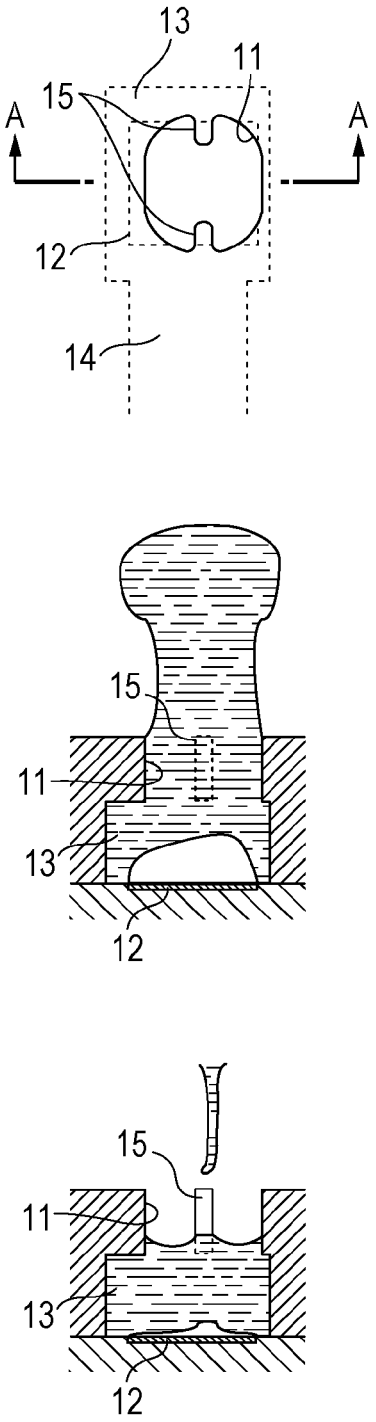
FIG. 11C is a diagram of the liquid ejection head according to the second embodiment.
Figure 11D:
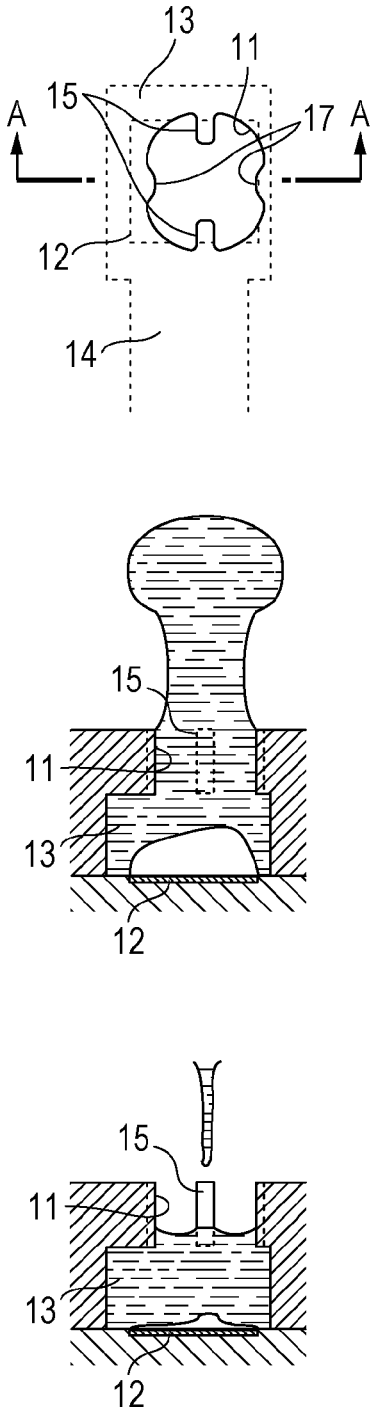
FIG. 11D is a diagram of the liquid ejection head according to the third embodiment.

On the other hand, variations in processing accuracy sometimes occur when the channels 14, the pressure chambers 13, and the discharge orifices 11 are manufactured using photolithography, as described above. As shown in FIG. 5, the opening of each discharge orifice 11 of the related art in a direction perpendicular to the direction in which ink flows from the channel 14 to the pressure chamber 13 is set longer than the opening of the discharge orifice 11 of the first embodiment in the direction perpendicular to the direction in which ink flows from the channel 14 to the pressure chamber 13. Therefore, as shown in FIGS. 6A and 6B, forming the discharge orifice 11 of the related art off the center the pressure chamber 13 makes the interval c between the edge of the discharge orifice 11 and the wall of the pressure chamber 13 extremely small. If ink is ejected in this state, the distribution of the ink flow rate in the discharge orifice 11 deviates due to the small interval c between the edge of the discharge orifice 11 and the wall 36 of the pressure chamber 13, so that the tail is formed at a position off the center of the discharge orifice 11, as shown in FIG. 11A. FIG. 11A illustrates the configuration of the comparative example, and FIGS. 11B to 11D illustrate configurations of first to third embodiments.

Since the ink to be ejected from the discharge orifice 11 is separated at the center of the discharge orifice 11 from remaining ink, the tail of the ink is bent from the position off the center of the discharge orifice 11 toward the center of the discharge orifice 11. This causes the satellites to be ejected in directions different from the ejection direction of the main drop, so that the landing positions of the satellites are displaced from the landing position of the main drop, thus degrading the image quality.

In the first embodiment, since the discharge orifices 11 have a long and thin shape in which the length in the direction in which ink flows from the channel 14 to the pressure chamber 13 is larger than the width in the direction perpendicular to the ink flowing direction, the interval c between the edge of the discharge orifice 11 and the wall 36 of the pressure chamber 13 is large. This reduces deviation in the distribution of the flow rate of the ink in the discharge orifice 11 to thereby reduce bending of the tail during ink ejection, as shown in FIG. 11B, thus preventing degradation of the quality of the image formed on the recording medium.

Figure 12A:
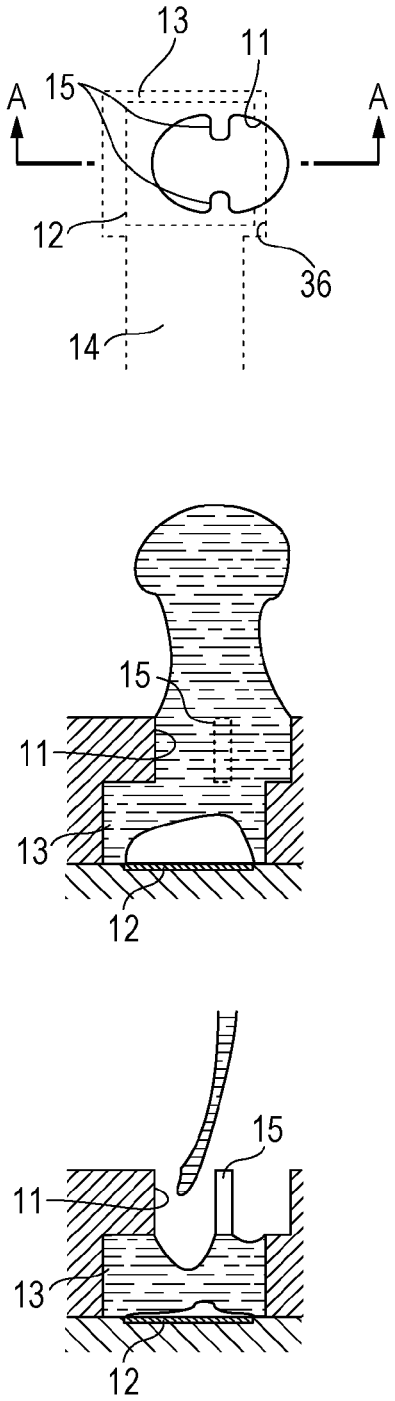
FIG. 12A is a diagram of the liquid ejection head of the comparative example.
Figure 12B:
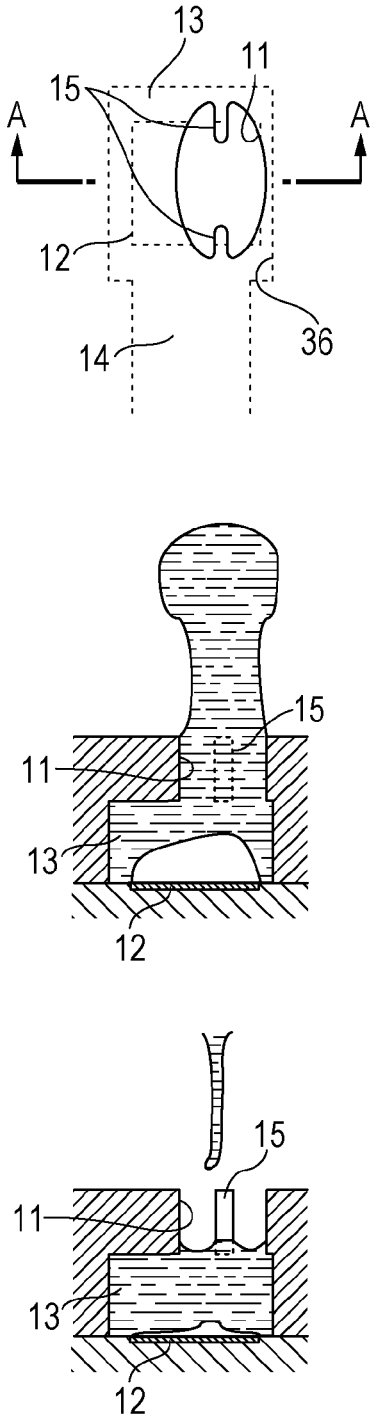
FIG. 12B is the liquid ejection head according to the first embodiment.

Furthermore, in the case where the deviation of the discharge orifice 11 from the center of the pressure chamber 13 is larger than that in FIGS. 11A to 11D, the ink is ejected as shown in FIGS. 12A and 12B. With the configuration of the comparative example in FIG. 12A, part of the right and left of the interior of the discharge orifice 11 divided by the protrusions 15 interferes with the wall 36 of the pressure chamber 13. This causes the ink flow rate in the discharge orifice 11 during ejection to be extremely lower at the interference side and higher at the opposite side, thus making the tail longer. This reduces the satellite reducing effect of the protrusions 15.

In contrast, in the case of FIG. 12B of the first embodiment, the interference of the discharge orifice 11 with the pressure chamber 13 is smaller than that in FIG. 12A even if the amount of deviation of the discharge orifice 11 from the center of the pressure chamber 13 is the same as that in FIG. 12A. This prevents the flow rates in the right and left areas of the interior of the discharge orifice 11 divided by the protrusions 15 from being significantly different, thus maintaining the satellite reducing effect.

Second Embodiment

Figure 7A:
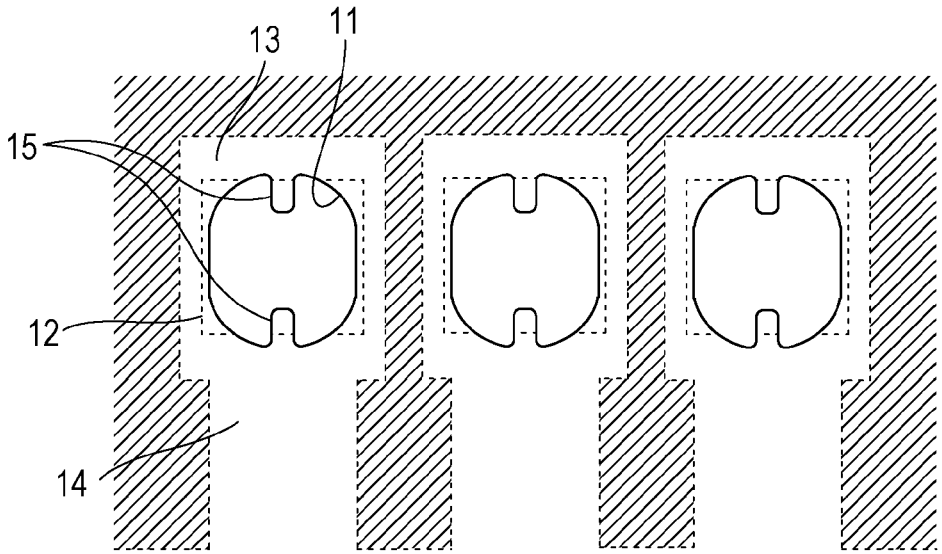
FIG. 7A is a plan view illustrating the positional relationship among discharge orifices, heaters, pressure chambers, and channels according to a second embodiment of the present invention.
Figure 7B:
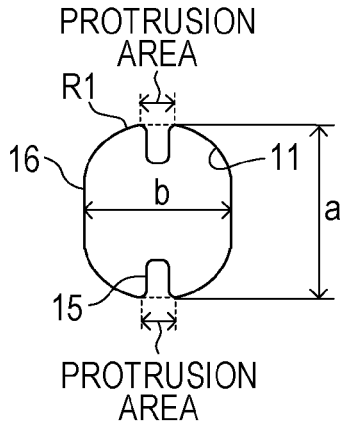
FIG. 7B is an enlarged view illustrating the shape of the discharge orifice.

FIGS. 7A and 7B are plan views of the ink ejection surface of a liquid ejection head according to a second embodiment of the present invention.

Discharge orifices 11 provided at the liquid ejection head are each defined by an edge having curvatures and has a long and thin shape in which a length a in a direction in which ink flows from the channel 14 to the pressure chamber 13 is larger than a width b perpendicular to the ink flowing direction. Although the width b of the discharge orifice 11 in the direction perpendicular to the direction in which the ink flows from the channel 14 to the pressure chamber 13 is the same as that of the discharge orifice 11 of the first embodiment, the length a in the ink flowing direction is smaller than that of the discharge orifice 11 of the first embodiment. The discharge orifice 11 has, at the edge thereof, straight portions 16 parallel to the direction in which ink flows from the channel 14 to the pressure chamber 13. In addition, the discharge orifice 11 has at least one (two, in the second embodiment) protrusion 15 at the edge. The protrusions 15 protrude from the edge of the discharge orifice 11 toward the central portion, or the center of the interior, of the discharge orifice 11 and are opposed to each other along a direction parallel to the channel 14.

The protrusions 15 and the edge of the discharge orifice 11 are connected in a curved shape. The curvature of portions R2 at which the direction in which ink flows from the channel 14 to the pressure chamber 13 and a tangent to the edge are parallel to each other is smaller than the curvature of portions R1 next to the protrusions 15. Since the length a of the discharge orifice 11 in the direction in which the ink flows from the channel 14 to the pressure chamber 13 is smaller than the length a of the discharge orifice 11 of the first embodiment, the curvature of the portions R1 next to the protrusions 15 is smaller than the curvature of the portions R1 next to the protrusions 15 of the first embodiment.

The other configurations will be omitted because they are the same as those of the first embodiment.

Figure 8A:
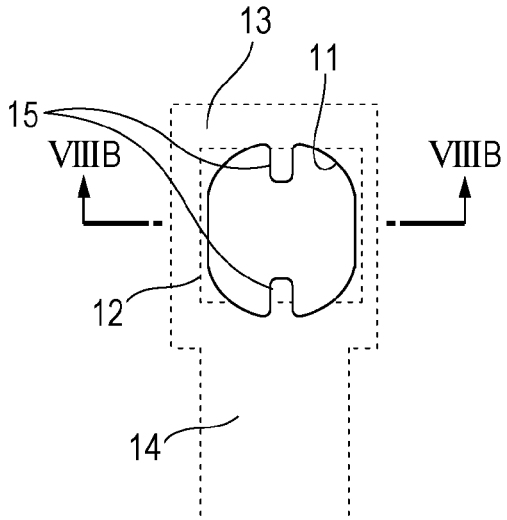
FIG. 8A is a plan view of the discharge orifice of the second embodiment in a displaced position due to variations in manufacturing process.
Figure 8B:
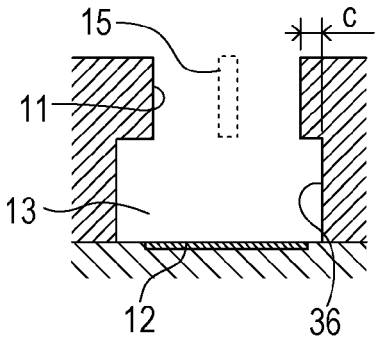
FIG. 8B is a cross-sectional view taken along line VIIIB-VIIIB in FIG. 8A.

FIGS. 8A and 8B illustrate a configuration in which the discharge orifice 11 is offset with respect to the center of the pressure chamber 13 because variations have occurred when the channels 14, the pressure chambers 13, and the discharge orifices 11 are formed using photolithography. The discharge orifice 11 is offset with respect to the pressure chamber 13 in the direction perpendicular to the direction in which ink flows from the channel 14 to the pressure chamber 13. However, providing the straight portions 16 at the discharge orifice 11 makes the interval c between the edge of the discharge orifice 11 and the wall 36 of the pressure chamber 13 larger than that without the straight portions 16. This reduces deviation in the distribution of the flow rate of ink in the discharge orifice 11 to thereby reduce bending of the tail during ink ejection, as shown in FIG. 11C, thus preventing degradation of the quality of the image formed on the recording medium.

Furthermore, the presence of the straight portions 16 reduces the viscosity resistance in the discharge orifice 11, which allows thermal energy necessary for ejecting ink to be reduced, allowing ink to be ejected with less energy, thus improving the ink ejection efficiency of the liquid ejection head. This can save electrical energy for generating thermal energy necessary for the liquid ejection head to eject ink.

Furthermore, the decrease in the viscosity resistance in the discharge orifice 11 makes it easy to eject ink, resulting in an increase in the ink ejection speed. Since the increase in the ink ejection speed makes the ink less prone to be subjected to air resistance and so on, the reliability of landing of the ink on a desired position of the recording medium is increased.

Third Embodiment

Figure 9A:
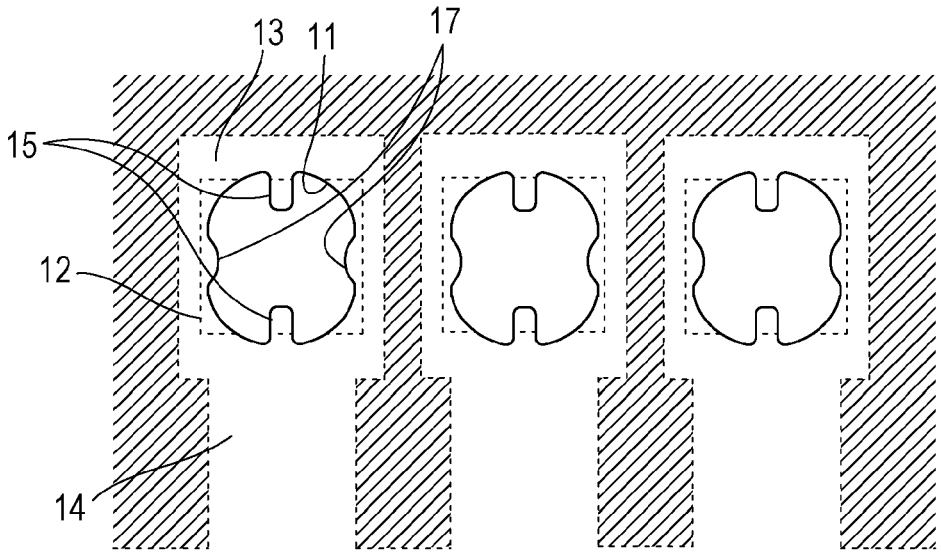
FIG. 9A is a plan view illustrating the positional relationship among discharge orifices, heaters, pressure chambers, and channels according to a third embodiment of the present invention.
Figure 9B:
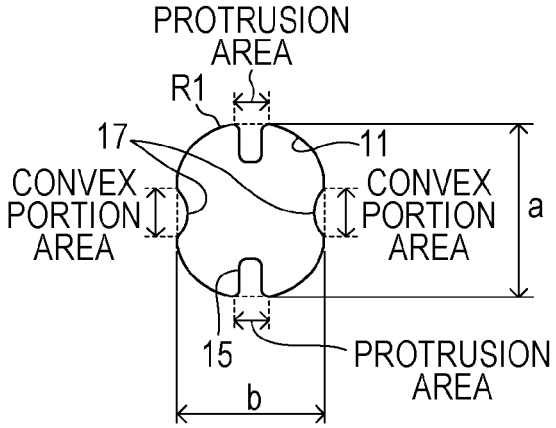
FIG. 9B is an enlarged view illustrating the shape of the discharge orifice.

FIGS. 9A and 9B are plan views of the ink ejection surface of a liquid ejection head according to a third embodiment of the present invention.

Discharge orifices 11 provided at the liquid ejection head are each defined by an edge having curvatures and has a long and thin shape in which a length a in a direction in which ink flows from the channel 14 to the pressure chamber 13 is larger than a width b perpendicular to the ink flowing direction. In addition, the discharge orifice 11 has, at the edge thereof, at least one (two, in the third embodiment) protrusion 15 and at least one (two, in the third embodiment) smoothly streamlined convex portion 17. The protrusions 15 protrude from the edge of the discharge orifice 11 toward the central portion, or the center of the interior, of the discharge orifice 11 and are opposed to each other in a direction parallel to the channel 14. The convex portions 17 are provided at portions R2 at which the direction in which ink flows from the channel 14 to the pressure chamber 13 and a tangent to the edge are parallel to each other and are opposed to each other in a direction perpendicular to the channel 14.

The protrusion amount from the edge of the discharge orifice 11 to the peak of the convex portion 17 is smaller than that from the edge of the discharge orifice 11 to the peak of the protrusion 15. For example, the protrusion amount of the protrusion 15 is 4 micrometers, and the protrusion amount of the convex portion 17 is 2 micrometers. At the edge of the discharge orifice 11, the linear distance of the area (convex-portion area) between the boundaries between the edge and the convex portions 17 is larger than that of the area (protrusion area) between the boundaries between the edge and the protrusions 15. For example, the linear distance of the protrusion area is 3 micrometers, and the linear distance of the convex-portion area is 6 micrometers. The width of the convex portion 17 (the length in a direction intersecting the protruding direction) is larger than the width of the protrusion 15.

The other configurations will be omitted because they are the same as those of the first embodiment.

Figure 10A:
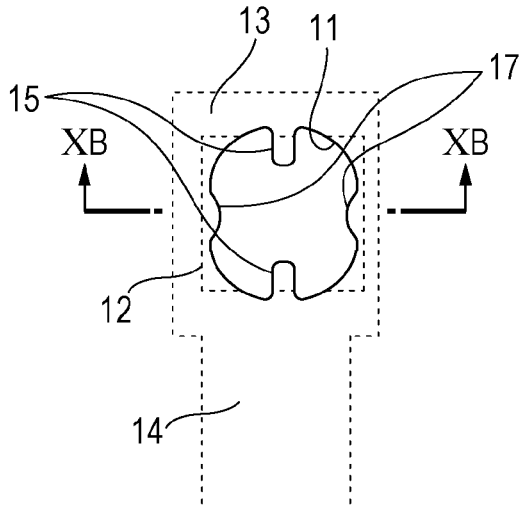
FIG. 10A is a plan view of the discharge orifice of the third embodiment in a displaced position due to variations in manufacturing process.
Figure 10B:
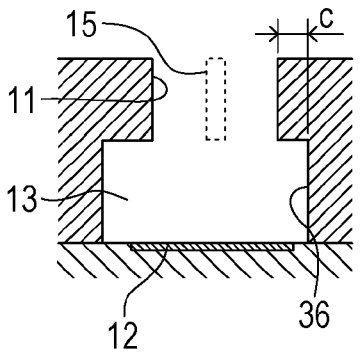
FIG. 10B is a cross-sectional view taken along line XB-XB in FIG. 10A.

FIGS. 10A and 10B illustrate a configuration in which the discharge orifice 11 is formed off the center of the pressure chamber 13 because variations have occurred when the channels 14, the pressure chambers 13, and the discharge orifices 11 are formed using photolithography. Specifically, the discharge orifice 11 is offset with respect to the pressure chamber 13 in the direction perpendicular to the direction in which ink flows from the channel 14 to the pressure chamber 13.

However, providing the convex portions 17 at the portions R2 at which the direction in which ink flows from the channel 14 to the pressure chamber 13 and a tangent to the edge are parallel to each other makes the interval c between the edge of the discharge orifice 11 and the wall 36 of the pressure chamber 13 larger than that without the convex portions 17. This reduces deviation in the distribution of the flow rate of the ink in the discharge orifice 11 to thereby reduce bending of the tail during ink ejection, as shown in FIG. 11D, thus preventing degradation of the quality of the image formed on the recording medium.

Furthermore, the presence of the smoothly streamlined convex portions 17 reduces the viscosity resistance in the discharge orifice 11, which allows thermal energy necessary for ejecting ink to be reduced, thus improving the ink ejection efficiency of the liquid ejection head. This can save electrical energy for generating thermal energy necessary for the liquid ejection head to eject ink Furthermore, the decrease in the viscosity resistance in the discharge orifice 11 makes it easy to eject ink, resulting in an increase in the ink ejection speed. Since the increase in the ink ejection speed makes the ink less prone to be subjected to air resistance and so on, the reliability of landing of ink on a desired position of the recording medium is increased.

As described above, since providing the protrusions 15 at the edge of the discharge orifice 11 shortens the tails of the droplets and decreases the number of satellites, degradation of the quality of the image formed on the recording medium can be prevented. Furthermore, even if the discharge orifices 11 are displaced due to variations in manufacturing process, the convex portions 17 of the discharge orifice 11 increase the interval c between the edge of the discharge orifice 11 and the wall 36 of the pressure chamber 13. Since the tails are prevented from bending during ejection of ink, the main drop and the satellites can be ejected in the same direction, and the decrease in the number of satellites prevents degradation of image quality.

Fourth Embodiment

Figure 13A:
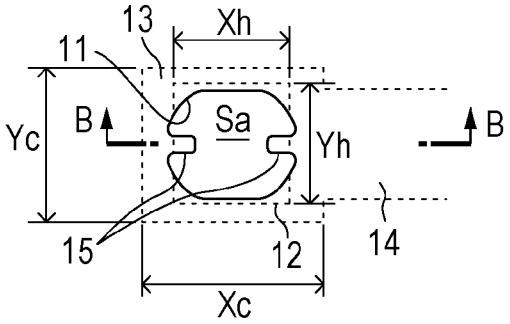
FIG. 13A is a diagram of the liquid ejection head according to the second embodiment.
Figure 13A:
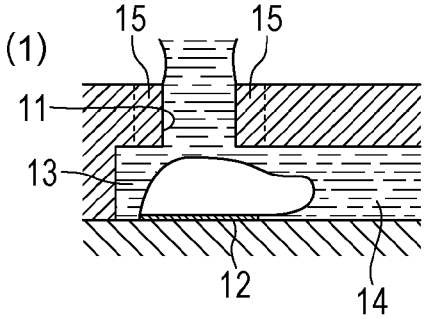
Figure 13A:
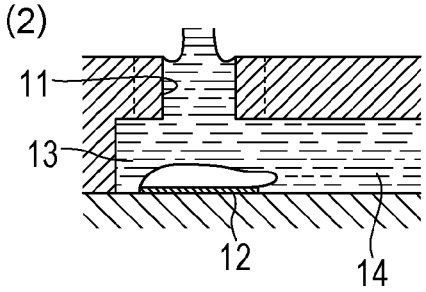
Figure 13B:
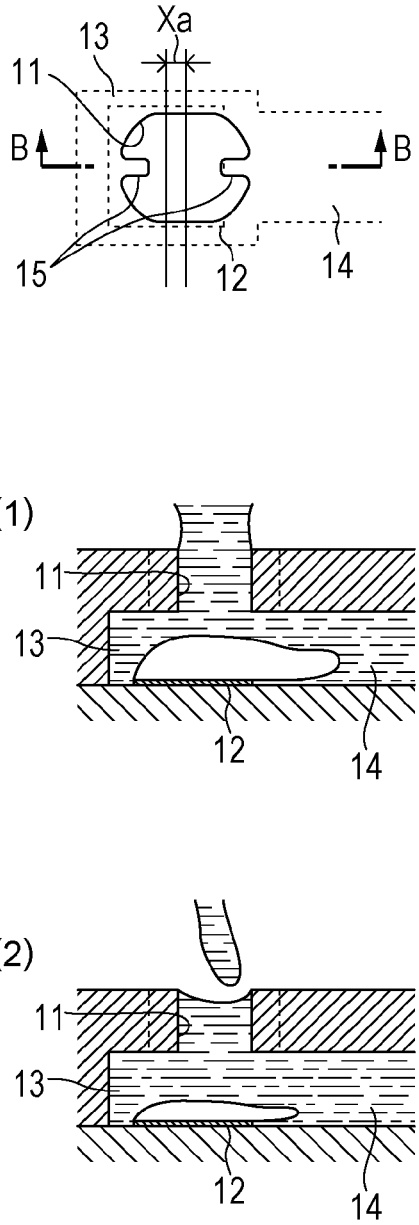
FIG. 13B is a diagram of a liquid ejection head according to a fourth embodiment of the present invention.

FIG. 13B shows a top view and a cross-sectional view of a nozzle according to a fourth embodiment of the present invention. FIG. 13A illustrates a nozzle according to the second embodiment of the present invention as a comparative example.

A difference between the fourth embodiment and the second embodiment is that the center (center of gravity) of the discharge orifice 11 is offset to the ink supply side with respect to the center (center of gravity) of the heater 12.

Specific design dimensions are as follows: size of heater Xh: 35 micrometers, size of heater Yh: 26 micrometers, area of discharge orifice Sa: 310 micro square meters, size of pressure chamber Xc: 40 micrometers, size of pressure chamber Yc: 28 micrometers, and amount of displacement of discharge orifice Xa: 2 micrometers.

An advantage of displacing the discharge orifice 11 to the ink supply side will be described using cross-sectional views (1) and (2) taken along line B-B of FIG. 13A. The B-B cross-sectional view (1) shows ink in a foamed state on the heater 12 during ejection. In the fourth embodiment shown in FIG. 13B, the discharge orifice 11 is displaced to the ink supply side, so that the foaming extends to the ink supply side more than that in FIG. 13A. This slightly collects the ink flows in the discharge orifice 11 to the ink supply side, causing deviation in flow rate also between the two protrusions 15. Thus, as shown in B-B cross-sectional views (2), the tail in the fourth embodiment of FIG. 13B is cut off earlier than that in FIG. 13A, and thus, the number of satellites can be reduced more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-238944, filed Oct. 30, 2012, which is hereby incorporated by reference herein in its entirety.

The invention claimed is:

1. A liquid ejection head comprising:

a plurality of discharge orifices arrayed in a predetermined direction; energy generation devices disposed in correspondence with the discharge orifices and configured to generate thermal energy for use in ejecting liquid; pressure chambers partitioned by walls, the pressure chambers each accommodating the energy generation device and communicating with the discharge orifice; and channels configured to supply liquid to the pressure chambers; wherein the edge of the discharge orifice has at least one protrusion protruding toward a central portion of each of the discharge orifices, and the discharge orifices have an elongated shape in which a length in a direction in which the liquid flows from the channel to the pressure chamber is larger than a width in a direction perpendicular to the liquid flowing direction, wherein a curvature of a first portion of the edge where the direction in which liquid flows from the channel to the pressure chamber and a tangent to the first portion are parallel to each other is smaller than a curvature of a second portion of the edge next to the protrusion, the second portion being except a portion where the protrusion is provided.

2. The liquid ejection head according to claim 1, wherein the edge of the discharge orifice has a straight portion along the direction in which liquid flows from the channel to the pressure chamber.

3. The liquid ejection head according to claim 1, wherein the protrusion protrudes in a direction parallel to the direction in which liquid flows from the channel to the pressure chamber.

4. The liquid ejection head according to claim 1, wherein the edge of the discharge orifice has at least one convex portion protruding from the edge toward the central portion of the discharge orifice at a first portion where the direction in which liquid flows from the channel to the pressure chamber and a tangent to the first portion are parallel to each other, and the protrusion amount of the convex portion is smaller than the protrusion amount of the protrusion.

5. A liquid ejection head comprising:

a discharge orifice configured to eject liquid;

a device configured to generate energy for use in ejecting liquid;

a pressure chamber partitioned by a wall, the pressure chamber accommodating the device and communicating with the discharge orifice; and a channel configured to supply liquid to the pressure chamber, wherein the discharge orifice has first and second protrusions protruding from the edge of the discharge orifice toward the central portion in an extending direction of the channel along the center line of the channel, and the interval between the base of the first protrusion and the base of the second protrusion in the extending direction of the channel is larger than the maximum interval between the edges of the discharge orifice in a direction perpendicular to the extending direction.

6. The liquid ejection head according to claim 5, wherein the center of gravity of the discharge orifice and the center of gravity of the energy generation device deviate from each other with respect to the perpendicular direction as viewed from a direction in which liquid is ejected from the discharge orifice.

7. The liquid ejection head according to claim 5, wherein the center of gravity of the discharge orifice and the center of gravity of the energy generation device deviate from each other with respect to the extending direction of the channel as viewed from a direction in which liquid is ejected from the discharge orifice.

* * * * *